US012055319B2

(12) United States Patent
Long et al.

(10) Patent No.: US 12,055,319 B2
(45) **Date of Patent: *Aug. 6, 2024**

(54) HVAC AIR FRESHENER

(71) Applicant: Freshlet, LLC, Winter Park, FL (US)

(72) Inventors: William N. Long, Lebanon, OH (US); Jay Parker Kronour, Lebanon, OH (US); John A. Kronour, Winter Park, FL (US)

(73) Assignee: Freshlet, LLC, Winter Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/329,237

(22) Filed: Jun. 5, 2023

(65) Prior Publication Data

US 2023/0324062 A1 Oct. 12, 2023

Related U.S. Application Data

(63) Continuation of application No. 16/895,034, filed on Jun. 8, 2020, now Pat. No. 11,692,721.

(60) Provisional application No. 62/858,511, filed on Jun. 7, 2019.

(51) Int. Cl.

| | |
|---|---|
| ***F24F 11/58*** | (2018.01) |
| ***F24F 8/50*** | (2021.01) |
| ***F24F 13/06*** | (2006.01) |
| ***F24F 13/20*** | (2006.01) |

(52) U.S. Cl.

CPC ..... *F24F 8/50* (2021.01); *F24F 11/58* (2018.01); *F24F 13/06* (2013.01); *F24F 13/20* (2013.01)

(58) Field of Classification Search

CPC .... F24F 3/16; F24F 11/58; F24F 13/06; F24F 13/20; F24F 8/50; F24F 1/008; F24F 1/0355

USPC ..... 62/78

See application file for complete search history.

(56) References Cited

U.S. PATENT DOCUMENTS

| | | | | |
|---|---|---|---|---|
| 5,273,690 | A | 12/1993 | McDowell | |
| 5,368,822 | A | 11/1994 | McNeil | |
| 5,431,859 | A * | 7/1995 | Tobin | F24F 3/12 261/DIG. 65 |
| 6,117,218 | A | 9/2000 | Snyder et al. | |
| 6,347,992 | B1 | 2/2002 | Durbin et al. | |
| 6,435,419 | B1 | 8/2002 | Davis | |
| 7,341,698 | B2 * | 3/2008 | Pedrotti | A61L 9/037 392/394 |
| 9,352,065 | B2 | 5/2016 | Habbel | |
| 9,435,550 | B1 | 9/2016 | Marinelli | |
| 9,539,356 | B2 | 1/2017 | Eike | |
| 2005/0031498 | A1 | 2/2005 | Held | |
| 2006/0121844 | A1 | 6/2006 | Sparks | |

(Continued)

*Primary Examiner* — Avinash A Savani
*Assistant Examiner* — Ryan L Faulkner
(74) *Attorney, Agent, or Firm* — Wood Herron & Evans LLP

(57) ABSTRACT

An HVAC air freshener comprises a cylindrical housing having at least one opening in the wall of the housing along the length of the housing, the housing adapted to be inserted through an opening in a planar portion of an HVAC plenum or ductwork, a fastener encircling and attached to the housing near one end of the housing and adapted to attach to an exterior planar surface of the plenum or ductwork, and a fragrance cartridge inserted into the housing. The fragrance from the fragrance cartridge escapes from the cartridge through the housing opening and into the plenum or ductwork.

19 Claims, 10 Drawing Sheets

(56) References Cited

U.S. PATENT DOCUMENTS

| | | | | |
|---|---|---|---|---|
| 2008/0061453 | A1 | 3/2008 | Diaz | |
| 2010/0219258 | A1 | 9/2010 | Starcic | |
| 2014/0150658 | A1* | 6/2014 | Prax | B01D 46/0002 96/74 |
| 2018/0295881 | A1* | 10/2018 | Mironov | H05B 3/26 |

* cited by examiner

HVAC AIR FRESHENER

RELATED APPLICATIONS

This application is a continuation of U.S. patent application Ser. No. 16/895,034 filed Jun. 8, 2020, which claims the priority benefit of U.S. Provisional Patent Application No. 62/858,551 filed Jun. 7, 2019, both of which are hereby incorporated by reference herein as if fully set forth in their entirety.

FIELD OF THE INVENTION

This invention relates generally to air fresheners, and more particularly to air fresheners of the type adapted to work with a homeowner's or a business owner's existing heating, ventilation, and air conditioning ("HVAC") system.

BACKGROUND OF THE INVENTION

Over the years many products have been proposed to impart a pleasant scent or fragrance to a home, office, etc. Some of those products are fragrance pods, scented candles, scented sprays, and scented light bulbs. Such products have typically met with less than satisfactory results. Some drawbacks of prior products are open flames which add soot and unwanted allergens into the air, not to mention being a fire hazard, and the attractive nuisance of electrical outlets, electrical cords, and the like to young children in the case of scented light bulbs.

Accordingly, there remains room for improvement in the field of imparting a pleasant scent or fragrance to a home, office, etc., that does not carry with it the drawbacks of prior scent imparting products.

SUMMARY OF THE INVENTION

In one aspect, an HVAC air freshener comprises a cylindrical housing having at least one opening in the wall of the housing along the length of the housing, the housing adapted to be inserted through an opening in a planar portion of an HVAC plenum or ductwork, a magnetic ring encircling and attached to the housing near one end of the housing and adapted to magnetically attach to an exterior planar surface of the plenum or ductwork, and a fragrance cartridge inserted into the housing. The fragrance from the fragrance cartridge escapes from the cartridge through the housing opening and into the plenum or ductwork.

The cartridge can contain absorbent material pre-wetted with fragrance liquid. Alternatively, the cartridge can include a reservoir of fragrance liquid on one end and a wick extending from the reservoir which wicks fragrance liquid from the reservoir along the length of the wick. The housing can include an openable and closable cap on the one end. The one end of the housing and the fragrance cartridge can be matingly threaded whereby the fragrance cartridge can be threaded into the housing. The fragrance cartridge can include at least one opening along the length of the cartridge whereby fragrance escapes from the cartridge. The housing can include at least one knife element on an interior thereof near the one end operable to slit the fragrance cartridge open along the length of the cartridge as the cartridge is inserted into the housing.

In another aspect, an HVAC air freshener comprises an elongated outer housing having at least one opening in a wall of the outer housing along a length of the outer housing, the outer housing adapted to be inserted through an opening in a planar portion of an HVAC plenum or ductwork, a magnet at least partially surrounding and attached to the outer housing near one end of the outer housing and adapted to magnetically attach to an exterior planar surface of the plenum or ductwork, and an elongated inner housing removably inserted into the outer housing, the inner housing having at least one opening in a wall of the inner housing along a length of the inner housing, the inner housing having a reservoir of fragrance liquid on one end and a wick extending from the reservoir towards the other end of the inner housing which wicks fragrance liquid from the reservoir along a length of the wick. The fragrance from the wick escapes from the inner housing through the opening in the inner housing and into the outer housing, and escapes from the outer housing through the opening in the outer housing and into the plenum or ductwork.

The outer housing can be cylindrical and can include a circular flange on the one end, and the magnet can be a magnetic ring encircling the outer housing and abutting the flange, such that the magnetic ring is positioned between the flange and the exterior planar surface of the plenum or ductwork when installed. The inner housing can be cylindrical and can have an internally threaded collar on the one end and the reservoir can have a matingly externally threaded collar on an end thereof, whereby the reservoir is threaded onto the inner housing. The amount of fragrance released from the outer housing into the plenum or ductwork can be adjusted by rotating the inner housing relative to the outer housing so as to partially or completely align the at least one opening in the inner housing with the at least one opening in the outer housing. The at least one opening in the inner housing can be a plurality of openings and the at least one opening in the outer housing can be a plurality of openings. The inner housing plurality of openings can include at least one inlet opening and at least one outlet opening, and the outer housing plurality of openings can include at least one inlet opening and at least one outlet opening.

In yet another aspect, an HVAC air freshener comprises an elongated cylindrical outer housing having at least one opening in a wall of the outer housing along a length of the outer housing, the outer housing adapted to be inserted through an opening in a planar portion of an HVAC plenum or ductwork, a circular flange on the one end of the outer housing, a magnetic ring encircling the outer housing, abutting the flange, and adapted to magnetically attach to an exterior planar surface of the plenum or ductwork, such that the magnetic ring is positioned between the flange and the exterior planar surface of the plenum or ductwork when installed, an elongated cylindrical inner housing removably inserted into the outer housing, the inner housing having at least one opening in a wall of the inner housing along a length of the inner housing, the inner housing having a reservoir of fragrance liquid on one end and a wick extending from the reservoir towards the other end of the inner housing which wicks fragrance liquid from the reservoir along a length of the wick, and the inner housing having an internally threaded collar on the one end and the reservoir having a matingly externally threaded collar on an end thereof, whereby the reservoir is threaded onto the inner housing. The an elongated inner housing removably inserted into the outer housing, the inner housing having at least one inlet opening and at least one outlet opening in a wall of the inner housing along a length of the inner housing, the inner housing having a reservoir of fragrance liquid on one end and a wick extending from the reservoir towards the other end of the inner housing which wicks fragrance liquid from the reservoir along a length of the wick, and the inner housing having an internally threaded collar on the one end and the reservoir having a matingly externally threaded collar on an end thereof, whereby the reservoir is threaded onto the inner housing. Air enters the at least one inlet opening of the outer housing and then enters the at least one inlet opening of the inner housing, the air carrying fragrance from the wick exiting the inner housing through the at least one outlet opening in the inner housing and exiting the outer housing through the at least one outlet opening of the outer housing, the air carrying the fragrance then entering the plenum or ductwork. The amount of fragrance released into the plenum or ductwork is adjusted by rotating the inner housing relative to the outer housing so as to partially or completely align the at least one inlet opening of the inner housing with the at least one inlet opening of the outer housing and the at least one outlet opening of the inner housing with the at least one outlet opening in the outer housing.

The inner housing at least one inlet opening and at least one outlet opening and the outer housing at least one inlet opening and at least one outlet opening can be sized and shaped such that rotating the inner housing in a first direction allows more air flow through the air freshener and rotating the inner housing in a second direction allows less air flow through the air freshener. The inner housing at least one inlet opening can be a plurality of openings, the inner housing at least one outlet opening can be a plurality of openings, the outer housing at least one inlet opening can be a plurality of openings, and the outer housing at least one outlet opening can be a plurality of openings. The outer housing inlet openings can be one row of slots extending along the length of the outer housing, the outer housing outlet openings can be three rows of slots extending along the length of the outer housing, the inner housing inlet openings can be one row of triangles extending along the length of the inner housing, and the inner housing outlet openings can be three rows of slots extending along the length of the inner housing. The one row of slots can be circumferentially spaced from the three rows of slots in the outer housing, and the one row of triangles can be circumferentially spaced from the three rows of slots in the inner housing.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
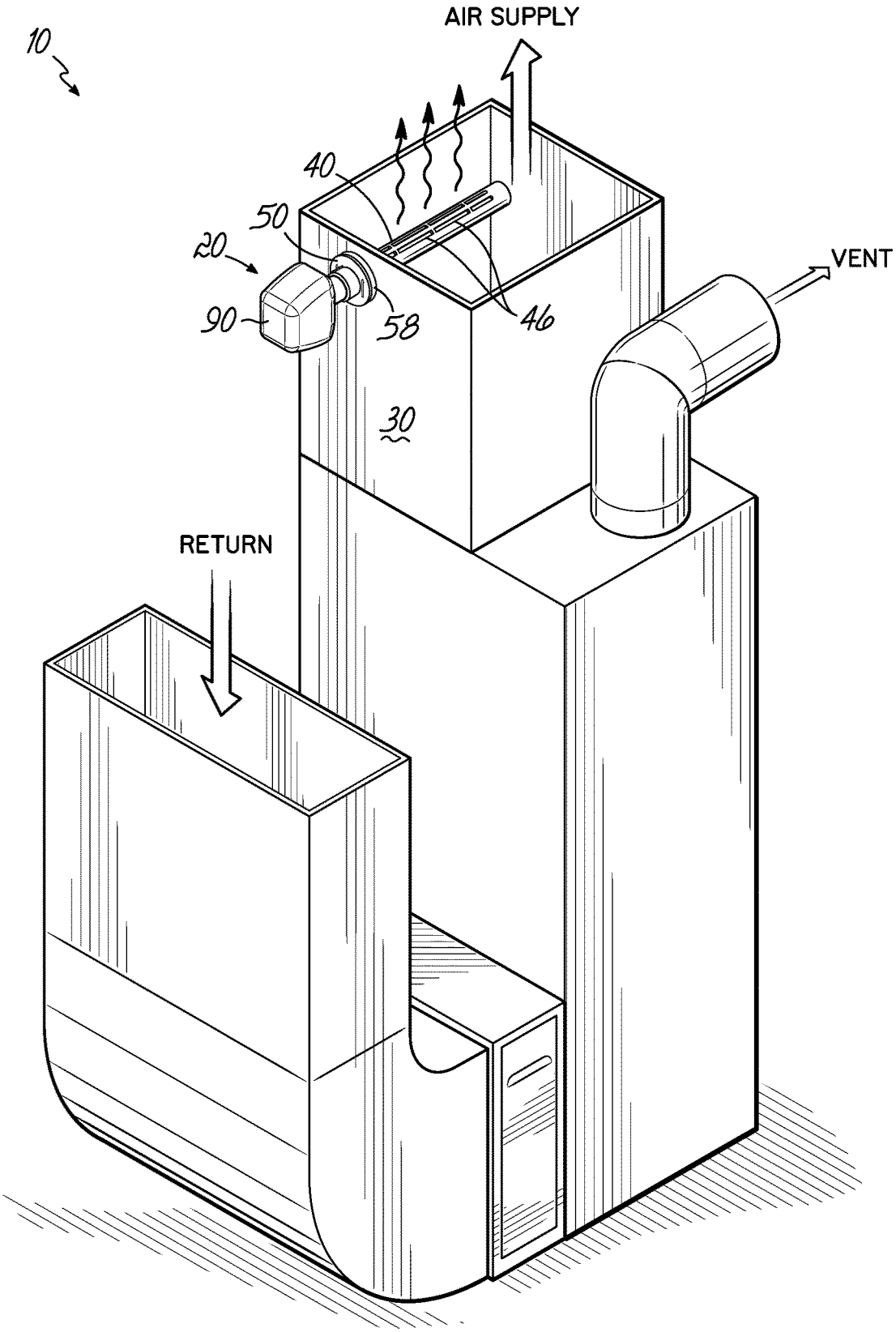
FIG. 1 is a perspective view of a portion of an HVAC system including the air freshener of the present invention.

Referring first to FIG. 1, there is illustrated a portion of a conventional a conventional HVAC system 10 with the HVAC air freshener 20 of the present invention installed in the HVAC system 10. The air freshener 20 is preferably installed to a planar portion 30 of a plenum or ductwork of the HVAC system 10, for reasons which will become apparent below. The invention is not limited to any actual location in the HVAC system 10. In other words, the air freshener 20 could be before or after the heat exchanger or essentially any other convenient location in the HVAC system 10.

Referring to FIGS. 2-4B, the air freshener 20 includes an outer housing 40 and an inner housing 42. Outer housing is preferably, but not necessarily, cylindrical, and includes a single row of slot-shaped inlet openings 44 on one side thereof and three rows of slot-shaped outlet openings 46 on the other side thereof. One end of the outer housing 40 includes a flange 50 thereon. The other end of the outer housing is closed as at 52. Near the closed end 52 of the outer housing is a circumferential slot 54, the purpose for which will become apparent below. A closely fitting annular or ring-shaped magnet 58 is slid or slipped over the closed end 52 of the outer housing 40 until it abuts the underneath side of the flange 50. An opening 59 (FIGS. 3A and 3B) 4 is formed in the plenum or ductwork of the HVAC system 10 for closely receiving the outer housing 40. The outer housing 40 is inserted into the plenum or ductwork until the ring-shaped magnet 58 magnetically attaches to the planar portion 30 of the plenum or ductwork of the HVAC system 10.

The inner housing 42 is also preferably, but not necessarily, cylindrical, and includes a single row of triangular shaped inlet openings 62 on one side thereof and three rows of slot-shaped outlet openings 64 on the other side thereof. One end of the inner housing 42 includes an internally threaded collar 66 thereon. The other end of the inner housing can be open or closed. Near that end of the inner housing 42 is a hole 70 for receiving a peg or pin or the like 72. Once the inner housing 42 is installed in the outer housing 40 the peg or pin 72 is inserted through the circumferential slot 54 and into the hole 70 to properly orient the inner housing 42 relative to the outer housing 40. See FIGS. 5A-5D.

Figure 2:
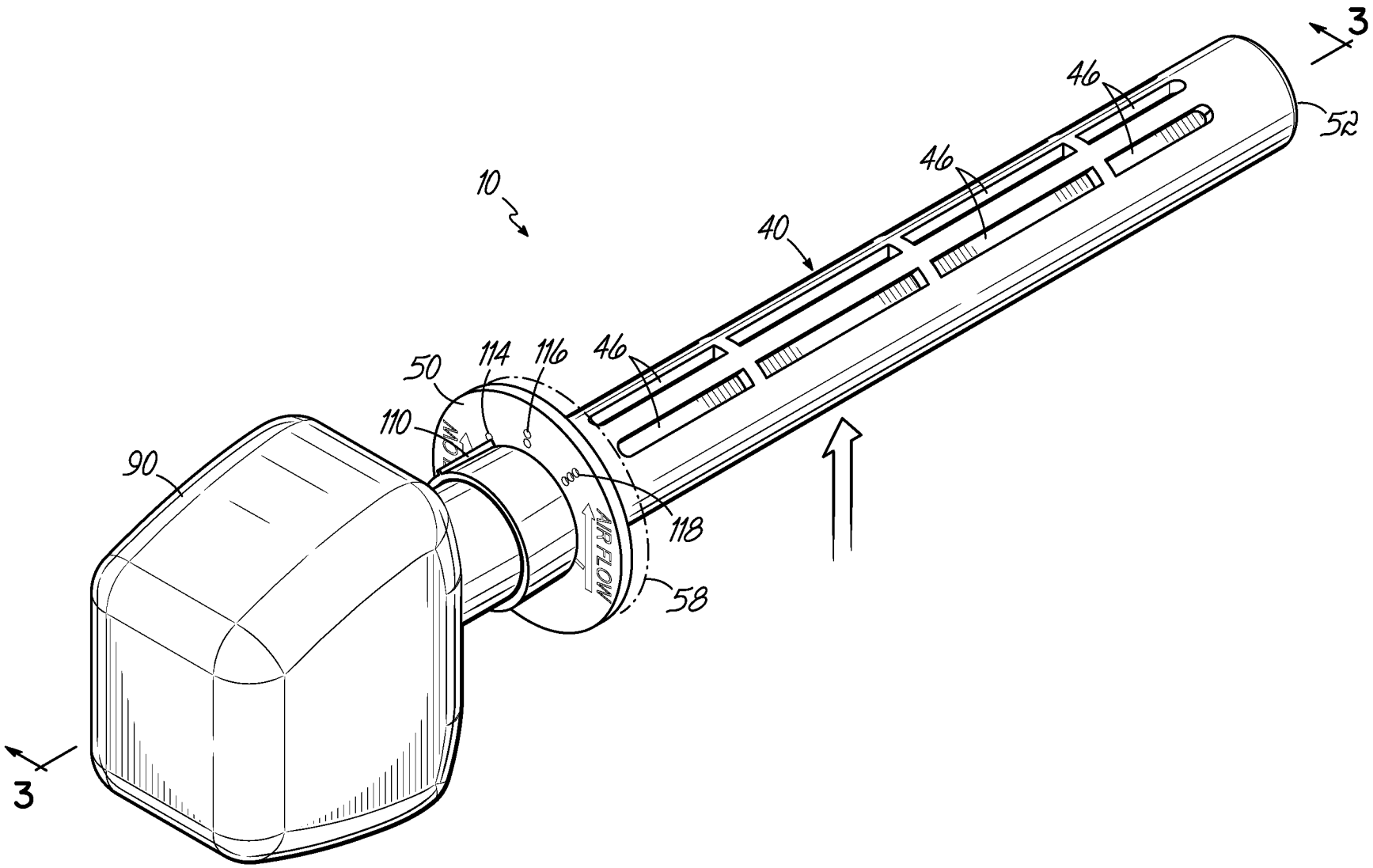
FIG. 2 is a perspective view of the air freshener of the present invention.
Figure 3A:
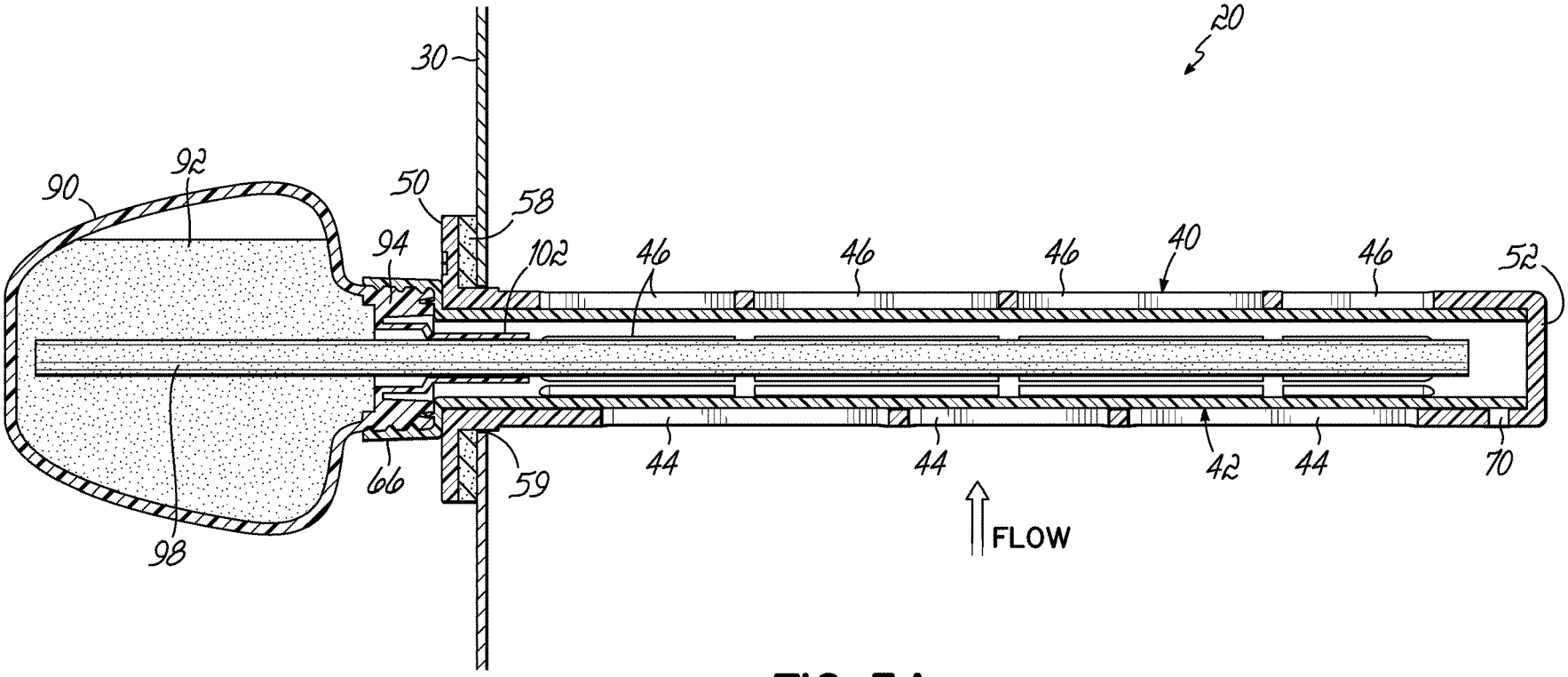
FIG. 3A is a cross-sectional view taken along line 3-3 of FIG. 2 with the air freshener closed.
Figure 3B:
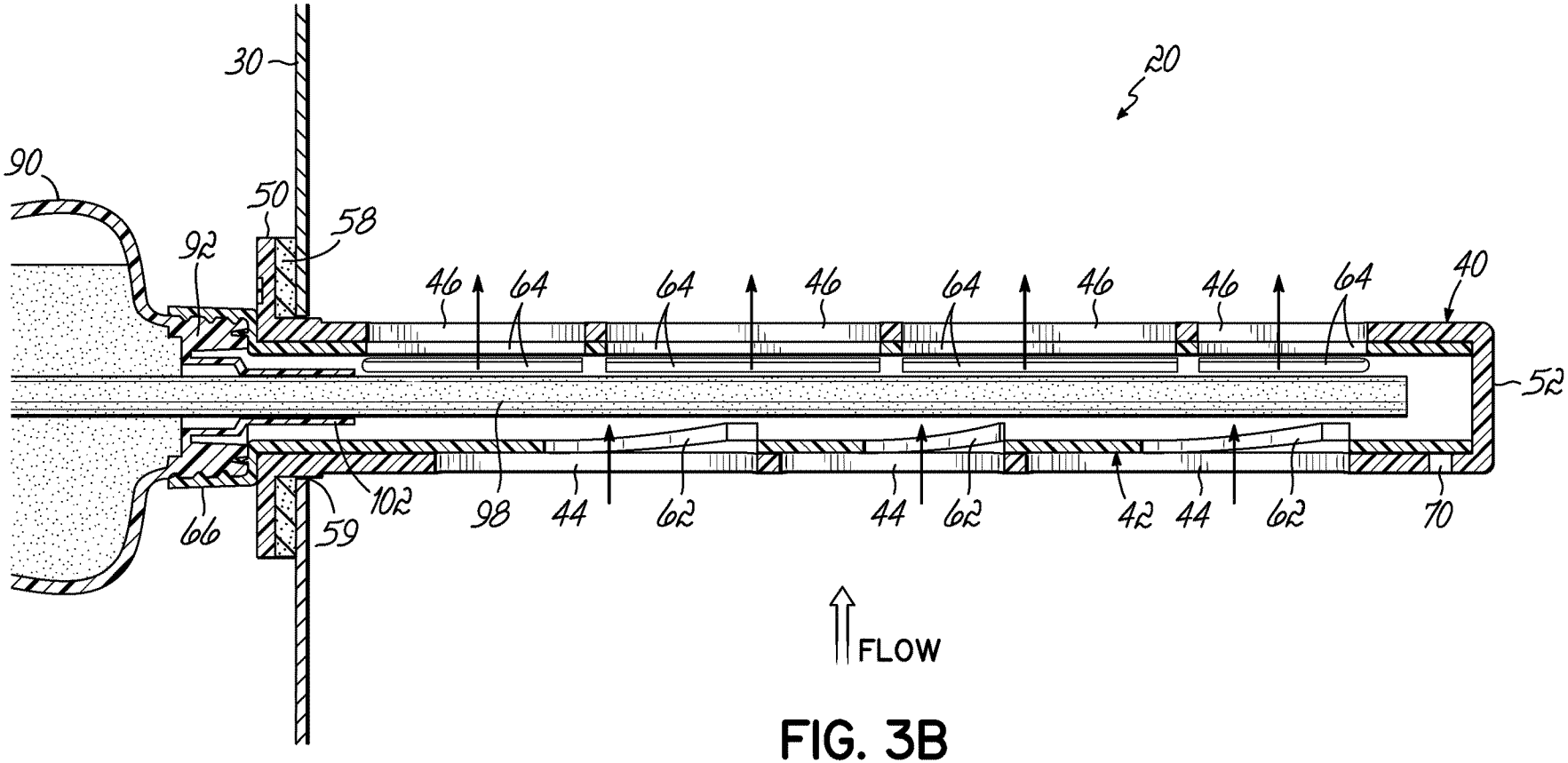
FIG. 3B is a cross-sectional view similar to FIG. 3A with the air freshener partially open.
Figure 4A:
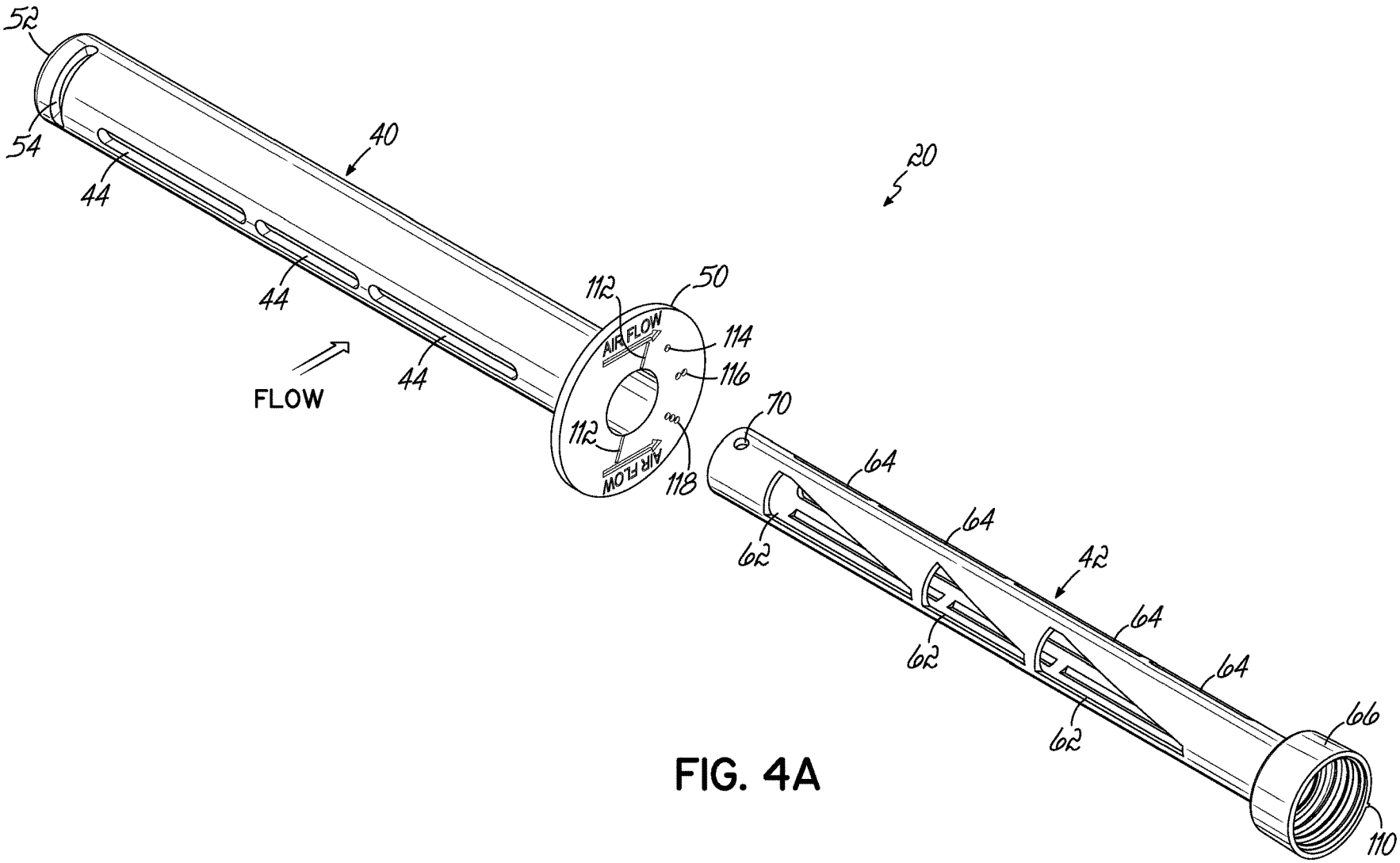
FIG. 4A is a rear, top, left exploded perspective view of the air freshener.
Figure 4B:
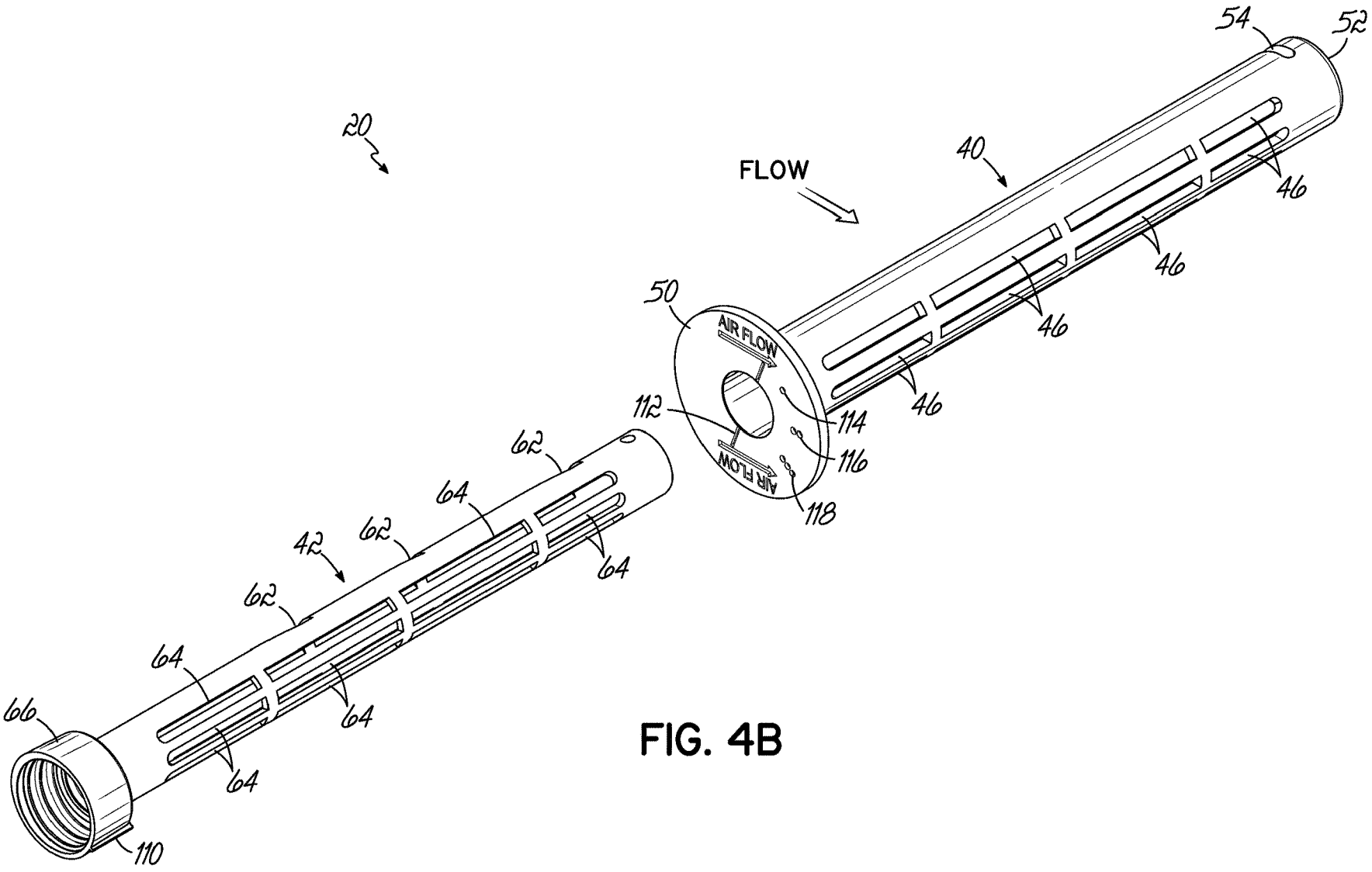
FIG. 4B is a rear, top, right exploded perspective view of the air freshener.

Referring to FIGS. 2-3B, a fragrance reservoir 90 includes a supply of liquid fragrance 92, for example scented oil. At one end the reservoir 90 has an externally threaded collar 94 that threads into the internally threaded collar 66 of the inner housing 42. A wick 98 extends from the reservoir 90 substantially the entire length of the inner housing 42. The wick 98 is preferably fabricated of a rubber/cotton material that absorbs the oil 92 and transfers it from the reservoir 90 along the length of the wick 98 to the distal end of the wick 98. The reservoir includes appropriate sealing structure as at 102 to prevent the fragrance liquid 92 from leaking, such that the only fragrance liquid 92 that escapes from the reservoir 90 is that which is wicked out of the reservoir 90 via wick 98.

The threaded collar 66 of the inner housing 42 includes an indicator rib 110 thereon. The outward side of the flange 50 of the outer housing 40 includes indicia 112, 114, 116, 118 to indicate the closed setting, low open setting, medium open setting, and high open setting, respectively. The inner housing 42 is rotated relative the outer housing 40 via collar 66 to align the indicator rib 110 with a selected setting 112, 114, 116, or 118.

The outer housing 40, inner housing 42, and reservoir 90 can all be advantageously fabricated of plastic.

Figure 5A:
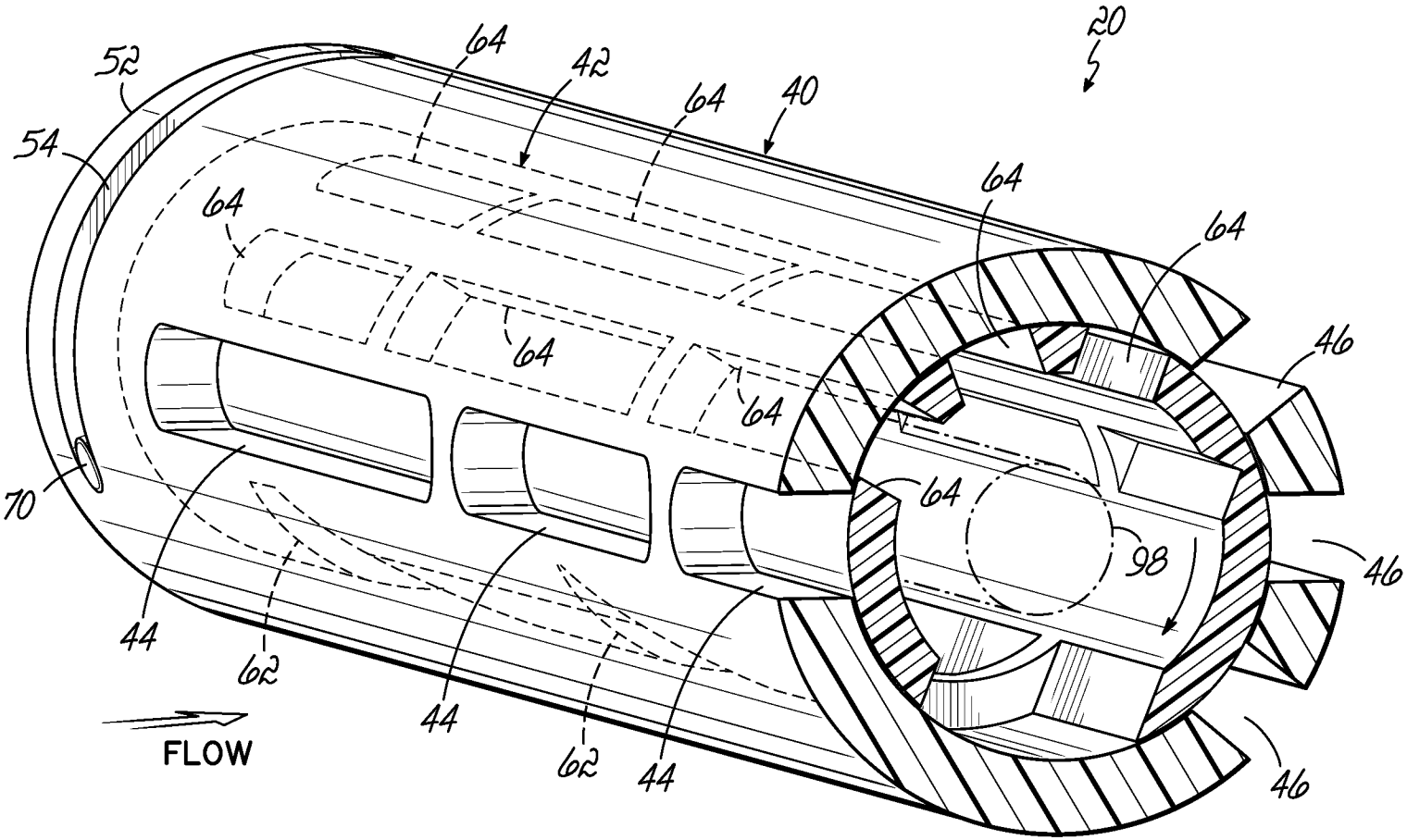
FIG. 5A is partial cross-sectional perspective view of the air freshener in the closed position.

Referring now to FIGS. 5A-5D, the function of the inner and outer housings 40, 42 in the closed 112, low open 114, medium open 116, and high open 118 settings will be described. The closed position is illustrated in FIG. 5A. In this position, the inlet openings 44 and outlet openings 46 of the outer housing 40 are completely closed off by the side wall of the inner housing 42. Thus, no air flow can enter or exit the air freshener 20.

Figure 5B:
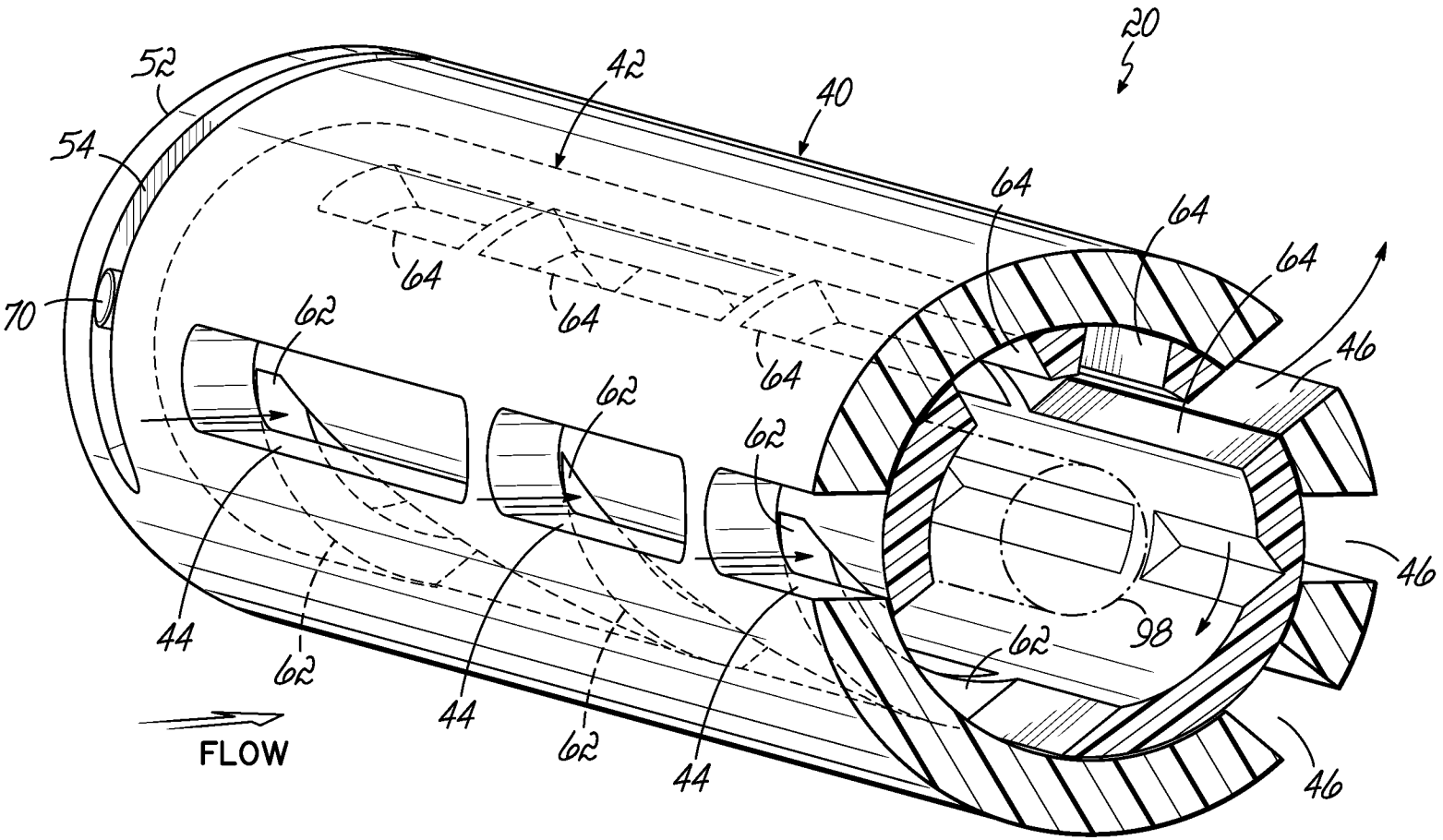
FIG. 5B is a view similar to FIG. 5A with the air freshener in the low open setting.

The low open position is illustrated in FIG. 5B. In this position, the inner housing 42 has been rotated clockwise relative to the outer housing 40 such that the triangular-shaped inlet openings 62 of the inner housing 42 just become visible through the slot-shaped inlet openings 44 of the outer housing 40. In this position, one row of slot-shaped outlet openings 64 in the inner housing 42 are aligned with one row of slot-shaped outlet openings 46 in the outer housing 40. In this position, a low amount of air flow can enter and exit the air freshener 20.

Figure 5C:
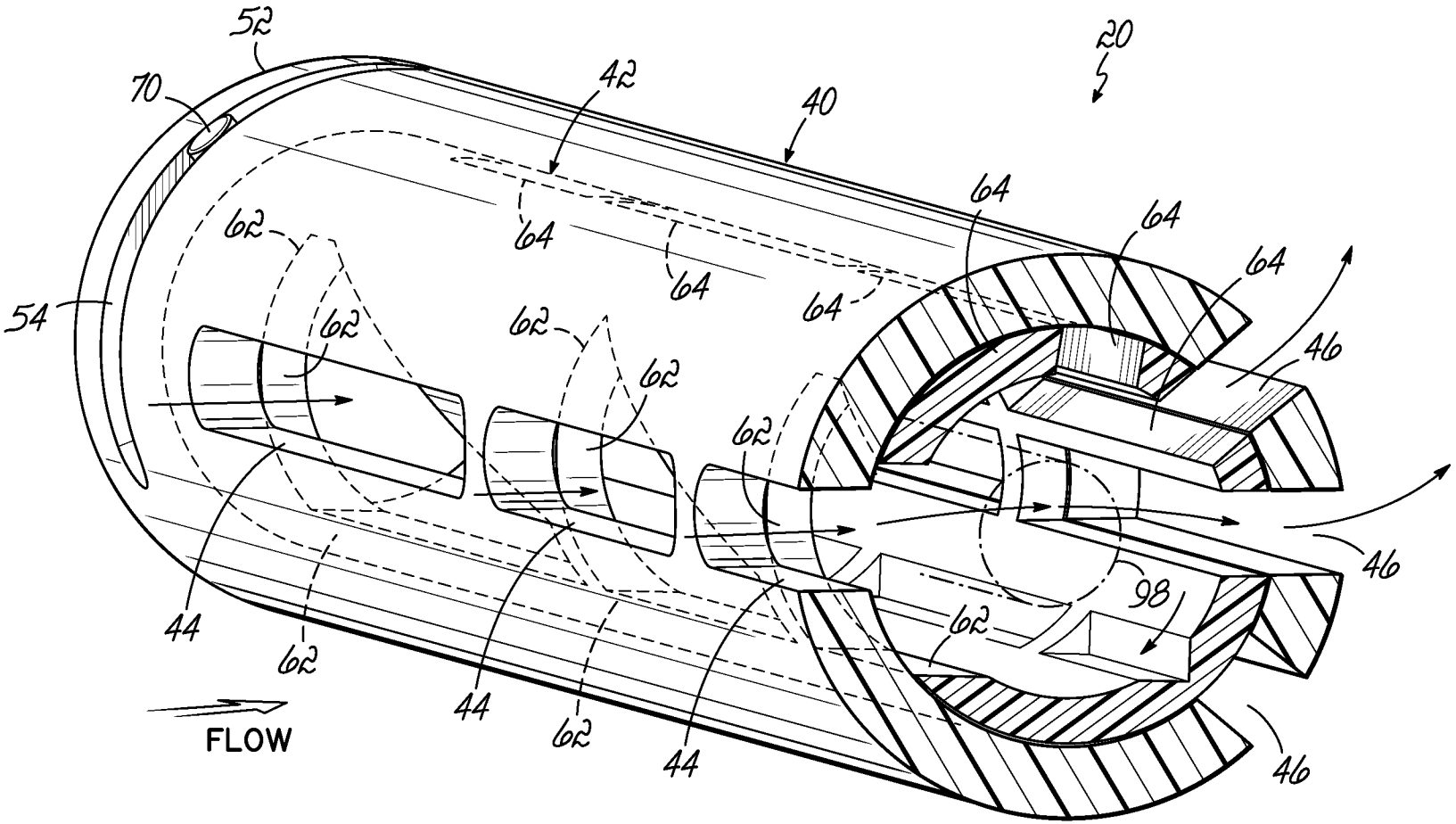
FIG. 5C is a view similar to FIG. 5B with the air freshener in the medium open setting.

The medium open position is illustrated in FIG. 5C. In this position the inner housing 42 has been rotated further clockwise relative to the outer housing 40. Due to the triangular shape of the inlet openings 62 in the inner housing 42, more air flow is permitted to enter the air freshener 20. In this position, two rows of slot-shaped outlet openings 64 in the inner housing 42 are aligned with two rows of slot-shaped outlet openings 46 in the outer housing 40. In this position, a medium amount of air flow can enter and exit the air freshener 20.

Figure 5D:
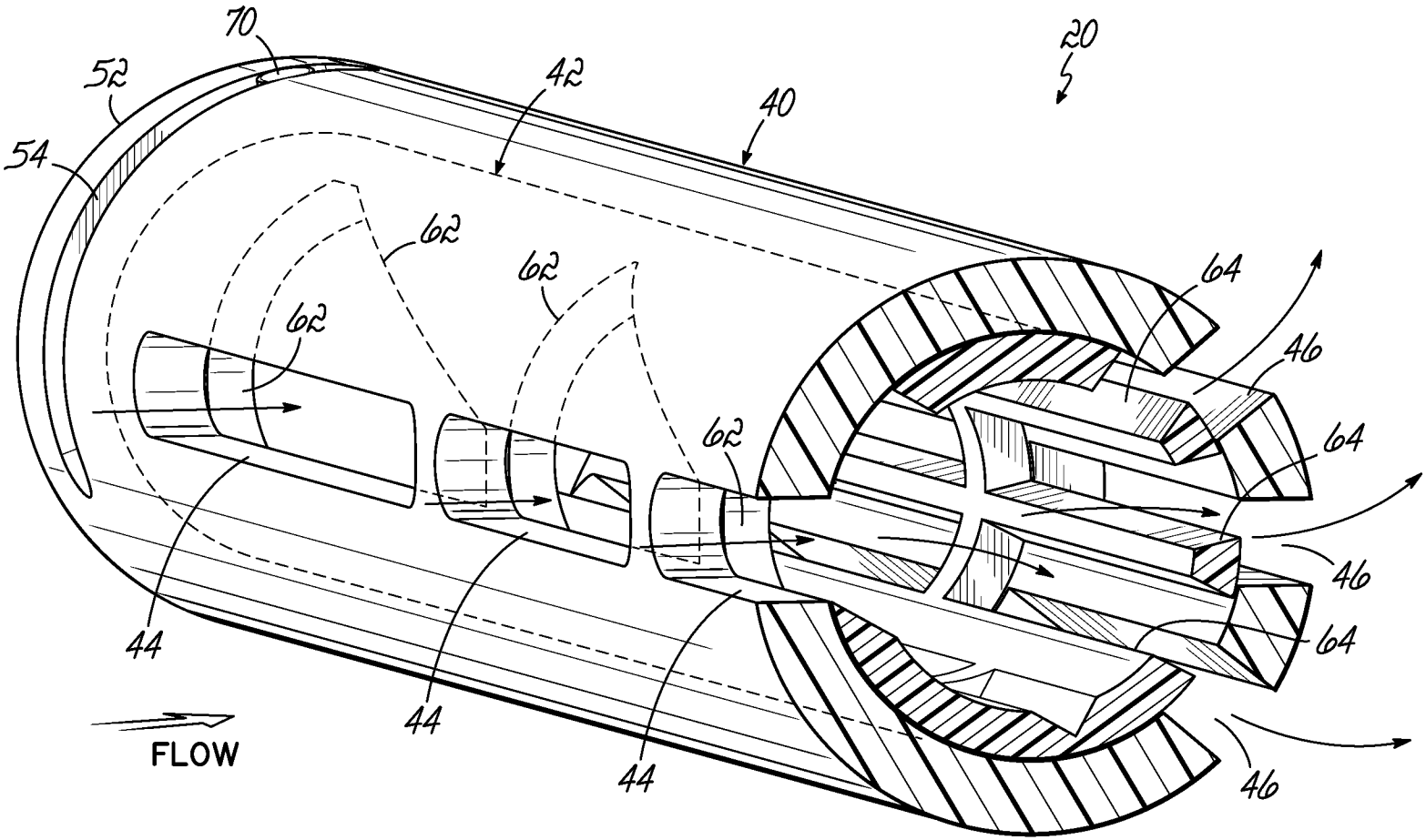
FIG. 5D is a view similar to FIG. 5C with the air freshener in the high open position.

The high open position is illustrated in FIG. 5D. In this position the inner housing 42 has been rotated still further clockwise relative to the outer housing 40. Due to the triangular shape of the inlet openings 62 in the inner housing 42, still more air flow is permitted to enter the air freshener 20. In this position, three rows of slot-shaped outlet openings 64 in the inner housing 42 are aligned with three rows of slot-shaped outlet openings 46 in the outer housing 40. In this position, a high amount of air flow can enter and exit the air freshener 20.

With the present invention homeowners/business owners will be able to eliminate odors throughout large areas within their homes/businesses. The present invention will also be more cost effective for the homeowner/business owner because it will eliminate the use of sprays, plug ins, candles, etc. The present invention will also encourage the homeowner/business owner to change the air filter on a more regular basis for overall cleaner air.

The present invention uses the existing ductwork already in the home/business. The homeowner/business owner purchases the housing, which is a one-time cost. Then, once installed, the homeowner/business owner periodically, for example monthly, purchases a fragrance cartridge in the fragrance of their choice for insertion into the housing. The ductwork acts as a natural circulation system. The fragrance diffuses through the ductwork when the fan is off but works best when the fan is in the on position or the HVAC system is calling for heating or cooling.

With the present invention the homeowner/business owner will not have the added cost of fragrance pods, candles, sprays, light bulbs for plug ins, etc. because they have a single and simple quick-change cartridge that lasts, for example, 30 days. The homeowner/business owner does not have to worry about open flames which add soot and unwanted allergens into the air, or about young children playing around outlets with cords or plug ins. The product diffuses a fragrance through the entire home/business and helps encourage the homeowner/business owner to periodically and routinely replace their HVAC filters for cleaner air.

Millions of HVAC systems are sold worldwide to residential and commercial consumers. Homeowners and business owners desire their homes and businesses to smell inviting and to promote a clean place to live and work. The present invention would be the perfect addition to any HVAC system. Ideally homeowners and business owners would be able to order the housing and fragrance cartridges of the present invention from an online business. The online business could be set up to ship a new fragrance cartridge to the homeowner or business owner periodically, for example every 30 days.

The present invention admits of additional ideas for fragrance cartridges that would provide additional benefits. As one example, the fragrance cartridge could be configured to change every 7-10 days, for example, with different scents, so people do not go "nose blind" to the same scent for 30 days. As another example, the fragrance cartridge could be configured to dispense special scents that relate to holidays or special events. In this connection, if a homeowner is trying to sell their home they could insert fresh baked chocolate chip cookie or fresh baked bread fragranced cartridges, which scientific research has suggested may trigger the brain to release dopamine/serotonin which gives the potential buyer a happy/euphoric feeling as they go through the home, leaving a lasting pleasant experience. This stands in stark contrast to the experience of walking into a home that has unpleasant odors (pets, garbage, fish, etc.), which can leave a lasting negative impression. As a further example, the fragrance cartridge could be configured to dispense the scent from essential oils like Thieves, which can be used as a disinfectant, peppermint which can be used for congestion, or lavender which can be used for an overall calming feeling. As a still further example, the fragrance cartridge could be configured to dispense fresh/clean/all-natural scents for businesses like nursing homes, doctors' offices, etc. that would help decrease anxiety in residents/patients.

The present invention also admits of the incorporation of multiple scented fragrance liquids/oils, and of bluetooth/wifi capability, so that the air freshener can be monitored and controlled via a tablet, laptop computer, desk top computer, smart phone, or the like, to alternate or cycle through multiple scents, and to monitor the current volume of fragrance liquid/oil in the reservoir.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An HVAC air freshener comprising: a housing comprising an elongated outer housing having at least one opening in a wall of the outer housing along the length of the outer housing, the outer housing adapted to be inserted through an opening in a planar portion of a plenum or ductwork of a pre-existing HVAC system, a fastener attached to the outer housing near one end of the outer housing and adapted to attach to an exterior planar surface of the plenum or ductwork, and an elongated inner housing removably inserted into the outer housing, the inner housing having at least one opening in a wall of the inner housing along a length of the inner housing, the inner housing having a fragrance cartridge inserted into the inner housing, the housing adapted to be located at a position within the pre-existing HVAC system such that fragrance from the fragrance cartridge escapes from the cartridge through the inner housing opening, into the outer housing, and into the plenum or ductwork to be delivered to the entirety of that portion of a home or business serviced by the pre-existing HVAC system, and wherein the outer housing is cylindrical and includes a circular flange on the one end, and wherein the fastener encircles the outer housing and abuts the flange, such that the fastener is positioned between the flange and the exterior planar surface of the plenum or ductwork when installed.

2. The HVAC air freshener of claim 1 wherein the fragrance cartridge contains absorbent material pre-wetted with fragrance liquid.

3. The HVAC air freshener of claim 1 wherein the fragrance cartridge includes a reservoir of fragrance liquid on one end and a wick extending from the reservoir which wicks fragrance liquid from the reservoir along the length of the wick.

4. The HVAC air freshener of claim 1 wherein the housing has a longitudinal axis and wherein the housing is positioned such that the longitudinal axis of the housing is perpendicular to the planar portion of the plenum or ductwork.

5. The HVAC air freshener of claim 1 wherein the one end of the housing and the fragrance cartridge are matingly threaded whereby the fragrance cartridge can be threaded into the housing.

6. The HVAC air freshener of claim 1 wherein the fragrance cartridge includes at least one opening along the length of the cartridge whereby fragrance escapes from the cartridge.

7. An HVAC air freshener comprising:

an elongated outer housing having at least one opening in a wall of the outer housing along a length of the outer housing, the outer housing adapted to be inserted through an opening in a planar portion of a plenum or ductwork of a pre-existing HVAC system, a fastener at least partially surrounding and attached to the outer housing near one end of the outer housing and adapted to attach to an exterior planar surface of the plenum or ductwork, and an elongated inner housing removably inserted into the outer housing, the inner housing having at least one opening in a wall of the inner housing along a length of the inner housing, the inner housing having a reservoir of fragrance liquid on one end and a wick extending from the reservoir towards the other end of the inner housing which wicks fragrance liquid from the reservoir along a length of the wick, the housing adapted to be located at a position within the pre-existing HVAC system such that fragrance from the wick escapes from the inner housing through the opening in the inner housing and into the outer housing, and escapes from the outer housing through the opening in the outer housing and into the plenum or ductwork to be delivered to the entirety of that portion of a home or business serviced by the pre-existing HVAC system, wherein the outer housing is cylindrical and includes a circular flange on the one end, and wherein the fastener encircles the outer housing and abuts the flange, such that the fastener is positioned between the flange and the exterior planar surface of the plenum or ductwork when installed.

8. An HVAC air freshener comprising:

an elongated outer housing having at least one opening in a wall of the outer housing along a length of the outer housing, the outer housing adapted to be inserted through an opening in a planar portion of an HVAC plenum or ductwork, a fastener at least partially surrounding and attached to the outer housing near one end of the outer housing and adapted to attach to an exterior planar surface of the plenum or ductwork, and an elongated inner housing removably inserted into the outer housing, the inner housing having at least one opening in a wall of the inner housing along a length of the inner housing, the inner housing having a reservoir of fragrance liquid on one end and a wick extending from the reservoir towards the other end of the inner housing which wicks fragrance liquid from the reservoir along a length of the wick, whereby fragrance from the wick escapes from the inner housing through the opening in the inner housing and into the outer housing, and escapes from the outer housing through the opening in the outer housing and into the plenum or ductwork, wherein the outer housing is cylindrical and includes a circular flange on the one end, and wherein the fastener encircles the outer housing and abuts the flange, such that the fastener is positioned between the flange and the exterior planar surface of the plenum or ductwork when installed.

9. The HVAC air freshener of claim 8 wherein the inner housing is cylindrical and has an internally threaded collar on the one end and the reservoir has a matingly externally threaded collar on an end thereof, whereby the reservoir is threaded onto the inner housing.

10. The HVAC air freshener of claim 8 the amount of fragrance released from the outer housing into the plenum or ductwork can be adjusted by rotating the inner housing relative to the outer housing so as to partially or completely align the at least one opening in the inner housing with the at least one opening in the outer housing.

11. The HVAC air freshener of claim 10 wherein the at least one opening in the inner housing is a plurality of openings and the at least one opening in the outer housing is a plurality of openings.

12. The HVAC air freshener of claim 11 wherein the inner housing plurality of openings include at least one inlet opening and at least one outlet opening, and wherein the outer housing plurality of openings include at least one inlet opening and at least one outlet opening.

13. An HVAC air freshener comprising:

an elongated cylindrical outer housing having at least one inlet opening and at least one outlet opening in a wall of the outer housing along a length of the outer housing, the outer housing adapted to be inserted through an opening in a planar portion of an HVAC plenum or ductwork, a circular flange on the one end of the outer housing, a fastener encircling the outer housing, abutting the flange, and adapted to attach to an exterior planar surface of the plenum or ductwork, such that the fastener is positioned between the flange and the exterior planar surface of the plenum or ductwork when installed, an elongated cylindrical inner housing removably inserted into the outer housing, the inner housing having at least one inlet opening and at least one outlet opening in a wall of the inner housing along a length of the inner housing, the inner housing having a reservoir of fragrance liquid on one end and a wick extending from the reservoir towards the other end of the inner housing which wicks fragrance liquid from the reservoir along a length of the wick, and the inner housing having an internally threaded collar on the one end and the reservoir having a matingly externally threaded collar on an end thereof, whereby the reservoir is threaded onto the inner housing, whereby air enters the at least one inlet opening of the outer housing and then enters the at least one inlet opening of the inner housing, the air carrying fragrance from the wick exiting the inner housing through the at least one outlet opening in the inner housing and exiting the outer housing through the at least one outlet opening of the outer housing, the air carrying the fragrance then entering the plenum or ductwork, and whereby the amount of fragrance released into the plenum or ductwork is adjusted by rotating the inner housing relative to the outer housing so as to partially or completely align the at least one inlet opening of the inner housing with the at least one inlet opening of the outer housing and the at least one outlet opening of the inner housing with the at least one outlet opening in the outer housing.

14. The HVAC air freshener of claim 13 wherein the inner housing at least one inlet opening and at least one outlet opening and the outer housing at least one inlet opening and at least one outlet opening are sized and shaped such that rotating the inner housing in a first direction allows more air flow through the air freshener and rotating the inner housing in a second direction allows less air flow through the air freshener.

15. The HVAC air freshener of claim 14 wherein the inner housing at least one inlet opening is a plurality of openings, the inner housing at least one outlet opening is a plurality of openings, the outer housing at least one inlet opening is a plurality of openings, and the outer housing at least one outlet opening is a plurality of openings.

16. The HVAC air freshener of claim 15 wherein the outer housing inlet openings are one row of slots extending along the length of the outer housing, the outer housing outlet openings are three rows of slots extending along the length of the outer housing, the inner housing inlet openings are one row of triangles extending along the length of the inner housing, and the inner housing outlet openings are three rows of slots extending along the length of the inner housing.

17. The HVAC air freshener of claim 16 wherein the one row of slots is circumferentially spaced from the three rows of slots in the outer housing, and wherein the one row of triangles is circumferentially spaced from the three rows of slots in the inner housing.

18. The HVAC air freshener of claim 13 further including Bluetooth and/or wifi capability, so that the air freshener can be monitored and controlled via a tablet, a laptop computer, a desk top computer, a smart phone, or the like.

19. The HVAC air freshener of claim 18 wherein the reservoir is configured to contain a plurality of different fragrance liquids, and wherein the air freshener can be controlled so as to alternate or cycle through the plurality of fragrance liquids, and to monitor the current volume of fragrance liquid in the reservoir.

* * * * *